United States Patent [19]

Hopson, III

[11] 4,249,315

[45] Feb. 10, 1981

[54] GUN SCOPE MOUNT SYSTEM

[76] Inventor: Walter G. Hopson, III, 4221 E. Irving Cir., Tucson, Ariz. 85711

[21] Appl. No.: 53,390

[22] Filed: Jun. 29, 1979

[51] Int. Cl.[3] ..... F41G 1/38

[52] U.S. Cl. ..... 33/250; 33/247; 42/1 S

[58] Field of Search ..... 33/250, 245, 246, 247, 33/248, 249; 42/1 S

[56] References Cited

U.S. PATENT DOCUMENTS

| | | | |
|---|---|---|---|
| 2,306,972 | 12/1942 | Meisel | 33/247 |
| 2,857,675 | 10/1958 | Kesselring | 33/245 |
| 3,045,351 | 7/1962 | Dayton | 33/248 |
| 3,750,318 | 8/1973 | Burris | 33/250 |
| 3,875,675 | 4/1975 | Krisay | 33/245 |
| 4,085,511 | 4/1978 | Kovac | 33/250 |

*Primary Examiner*—William D. Martin, Jr.
*Attorney, Agent, or Firm*—Cahill, Sutton & Thomas

[57] ABSTRACT

A rifle scope mount system includes a base having forward and rear mounting blocks attachable to a rifle barrel. Forward and rear scope clamp rings are attachable to a telescope engagable with the forward and rear mounting blocks, respectively, to mount the telescope to the gun. The forward mounting block has a female dovetail recess for rotatably receiving a male dovetail stud extending from the forward clamp ring. The rear mounting block has a flat upper surface. The rear clamp ring has a flat lower surface which is coplanar with the flat upper surface when the male dovetail stud and the female dovetail recess are mated. A first windage screw is threaded into a first hole in a first side of the rear mounting block so that its head extends above the flat upper surface and engages one side of the rear clamp ring. A second windage screw is threaded into a second hole on the opposite side of the rear mounting block. The head of the second windage screw has a flat surface. The second windage screw can be rotated so that its flat surface is co-planar with the upper flat surface, whereby the flat lower surface of the rear clamp ring can be slid along the flat upper surface. The first windage screw is then rotated so that its head tightly engages the second side of the pedestal of the rear clamp ring. A removable clip can be attached to engage the second windage screw within a coin slot therein to facilitate tightening and loosening of the second windage screw.

8 Claims, 8 Drawing Figures

GUN SCOPE MOUNT SYSTEM

BACKGROUND OF THE INVENTION

1. Field of the Invention

The invention relates to telescope mounting systems for guns, and particularly to telescope mounting systems which enable a telescope to be conveniently and rapidly mounted to or dismounted from a gun.

2. Description of the Prior Art

A variety of gun sight or telescope mounts have been proposed and utilized. A very high degree of precision is required for gun telescope mounts in order to obtain and retain a desired level of accuracy in aligning the telescope to the bore of the rifle on which it is mounted. It is very desirable that the telescope be easily mountable and dismountable without changing the alignment between the cross-hairs of the telescope and the bore of the gun or rifle due to the fact that the procedure for obtaining such alignment is a tedious and time-consuming task. In order to protect a telescope to prevent it from being damaged and/or "knocked out" of alignment due to rough handling, it is desirable to be able to easily remove the telescope during transporting or storage of the gun to which it is mounted.

One prior system which enables a telescope to be quickly mounted and dismounted from a rifle is disclosed in U.S. Pat. No. 1,856,549, issued to Griffin. The disclosed device includes a base block attached to the rifle breach with a dovetail aligned with the direction of the rifle bore. The dovetail forms a tongue fitting into a mating female dovetail recess attached to a pair of forward scope clamp rings. A lever is attached to a shaft which extends through a mounting block in which the female dovetail recess is located. The shaft has a flat surface thereon. The male dovetail has a corresponding transverse semi-circular groove into which the rounded portion of the shaft tightly fits when the telescope is rigidly mounted. The handle can be turned so that the flat surface of the shaft is co-planar with the upper surface of male dovetail stud, allowing the telescope assembly to be quickly dismounted from the rifle. The telescope mounting system disclosed in U.S. Pat. No. 1,856,549 includes a large number of extensive precision surfaces, and is consequently very expensive. For example, a presently commercially available device embodying the principles of U.S. Pat. No. 1,856,549 now retails for roughly $100.

Another commonly available telescope mounting system, referred to as a "Redfield mount", is described in U.S. Pat. No. 1,837,290. A scope mounting system somewhat similar to the one described in U.S. Pat. No. 1,837,290 retails for roughly $30 and provides an acceptable degree of precision and convenience. The device utilizes a forward mounting block into which a male dovetail from a forward telescope clamp or ring fits and is tightened as a telescope to which the forward telescope clamp is attached is rotated about the male dovetail stud. A flat lower surface of the rear clamp ring slides along a co-planar flat upper surface of the rear mounting block until it is engaged by the head of a first windage screw. The head of a second windage screw identical to the first engages the rear clamp ring, rigidly securing the rear clamp ring and the rear mounting block together. Both windage screws are screwed tightly into threaded holes in the rear mounting block. Both have large cylindrical heads with flanges with beveled inner surfaces which mate with correspondingly beveled semicircular grooves in opposed sides of the rear clamp ring. One of the screws in the presently marketed device must be completely removed by means of a coin or a thick bladed screwdriver in order to mount or dismount the assembly, including the clamp rings and the telescope from the mounting blocks. This often results in a substantial inconvenience to the hunter, since a screwdriver or properly sized coin must be located to loosen the second windage screw by turning it approximately six turns to remove it from its hole and care must be taken not to lose the screw, as can often happen under field conditions on hunting trips, especially under weak lighting conditions.

U.S. Pat. No. 1,837,290 discloses an impractical embodiment wherein one windage screw is replaced by an assembly including a cylindrical, slotted nut and a threaded shaft pivotally attached to the rear mounting block. When the cylindrical nut is loosened, the threaded shaft can be pivoted downward so that the rear clamp ring can be slid sideways along the flat upper surface of the rear mounting block, avoiding the cylindrical nut. However, this system has been unsatisfactory and is not now commercially utilized due to its inherent weakness and greater cost than the presently available Redfield mount. Another disadvantage to the disclosed system is that the cylindrical nut has a slot engagable by a screwdriver to facilitate tightening and loosening the nut. However, when the nut is tightened with the telescope mount in place, the threaded shaft extends through the slot so that a specialized screwdriver is required to loosen the cylindrical nut to permit dismounting of the telescope.

Accordingly, it is an object of the invention to provide an improved gun telescope mounting system which is highly accurate, yet is substantially less expensive than prior art gun telescope mounting systems which allow rapid removal of a telescope without removal of any screws or other parts.

Another object of the invention is to provide a telescope mounting system which permits mounting and dismounting of the scope without use of a screwdriver or other tool.

Yet another object of the invention to provide a mounting system which facilitates mounting or dismounting of the scope without complete removal of a windage screw.

Still another object of the invention is to reduce the amount of times required to mount and dismount a telescope from a gun compared to the corresponding times required for known telescope mounting systems.

A novelty search directed to the present invention uncovered, in addition to the two patents referred to above, U.S. Pat. Nos. 3,945,142; 2,810,963; 3,877,167; 2,407,977 and 1,835,576.

SUMMARY OF THE INVENTION

Briefly described, and in accordance with one embodiment thereof, the invention includes a telescope mounting apparatus for mounting a telescope on a gun. The telescope mounting apparatus includes a forward clamp ring assembly which rigidly engages the body or barrel of a telescope and a rear clamp ring assembly spaced from the first clamp ring assembly rigidly engaging the body of the telescope. The telescope mounting apparatus also includes a forward mounting block rigidly attachable to the receiver or barrel of the gun and a rear mounting block also rigidly attachable to the receiver or barrel of the gun and spaced from the first mounting block. The first clamp ring assembly includes a male dovetail stud which can be inserted into and rotated to engage a circular female dovetail recess at the forward mounting block as the telescope is rotated in a direction tending to align it with the barrel of the gun. The rear clamp ring assembly includes a pedestal having a lower flat surface which slides along an upper flat surface of the rear mounting block. When the male dovetail stud is engaged with the female dovetail recess, the lower flat surface of the pedestal and the upper flat surface of the rear mounting block are co-planar. First and second windage screw are disposed in opposite ends of a threaded horizontal hole in the rear mounting block. The first windage screw has a large cylindrical head which extends above the flat surface and engages a first side of the pedestal by fitting into a semi-circular beveled slot therein. A second windage screw threaded into the opposite side of the threaded hole has a large partially cylindrical head having a flat surface parallel to the axis of the second windage screw. The second windage screw can be rotated so that the flat surface is co-planar with the upper flat surface of the first mounting block, allowing the lower flat surface of the pedestal to pass over the second windage screw, slide along the upper flat surface of the rear mounting block, and engage the flange of the first windage screw. The pedestal of the rear clamp ring assembly is rigidly engaged to the rear mounting block by rotating the second windage screw clockwise, causing the cylindrical portion of its head to extend above the upper flat surface of the rear mounting block. The second windage screw is then tightened to securely engage the beveled semi-circular groove in the adjacent sides of the pedestal, completing the process of mounting the telescope on the gun. Removal of the telescope is achieved by rotating the second windage screw counterclockwise less than one turn, so that its flat surface is co-planar with the upper flat surface of the rear mounting block. The pedestal is then slid away from the first windage screw across the flat surface of the second windage screw and is laterally rotated sufficiently far to disengage the dovetail male stud from the female recessed circular dovetail in the forward mounting block.

A removable wing clip tightly engageable to the second windage screw within its coin slot obviates the need for use of a coin or screwdriver to tighten or untighten the second windage screw.

DESCRIPTION OF THE INVENTION

Figure 1:
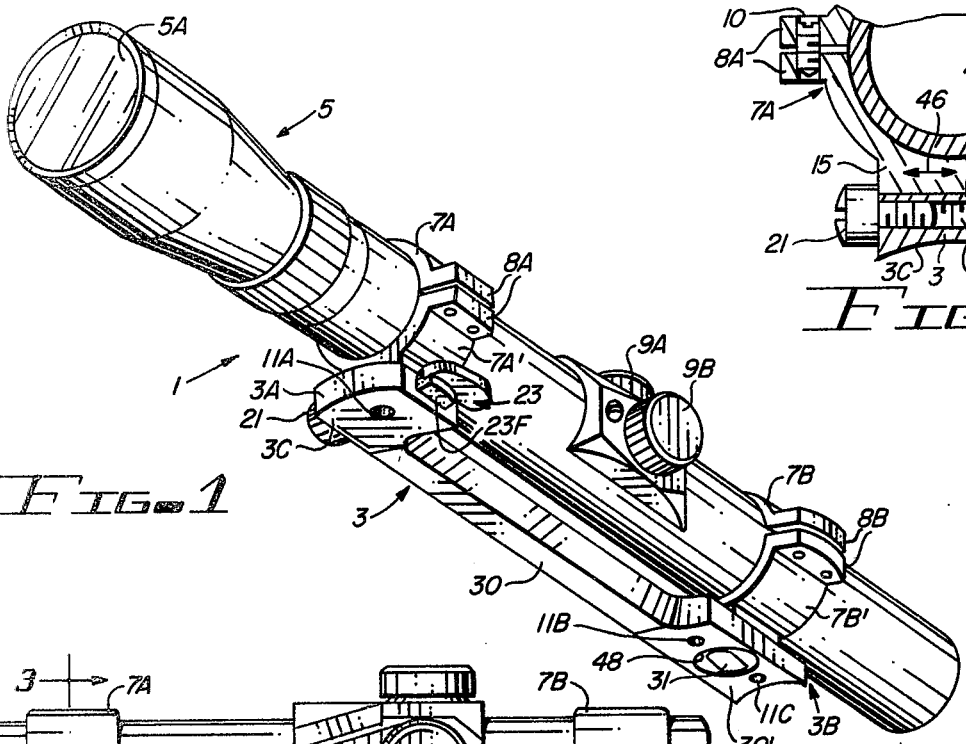
FIG. 1 is a perspective view of the scope mounting system of the present invention.

Referring now to the drawings, and particularly to FIG. 1, scope mounting system 1 includes a base 3, a rear clamp ring assembly 7 and a forward clamp ring assembly 7'. Base 3 includes rear mounting block 3A and forward mounting block 3B connected together by means of spanning member 3D. As seen more clearly in FIG. 3, lower surface 3C of forward mounting block 3B and lower surface 3C' of rear mounting block 3A are convex surfaces which mate with the receiver or barrel 29 (FIG. 5) of a gun or rifle to which base 3 is attached by means of screws passing through holes 11A, 11B and 11C.

Rear clamp ring assembly 7 includes an upper clamp ring 7A and a lower clamp ring 7A' having a pedestal 15. Upper and lower clamp rings 7A and 7A' have flanges 8A. Forward clamp ring assembly 7' includes an upper clamp ring 7B having a pair of flanges 8A and also includes a lower clamp ring 7B' having a pair of flanges 8A. The upper and lower clamp rings of each pair of clamp rings are tightened around the barrel of telescope 5 by means of screws 10.

Figure 2:
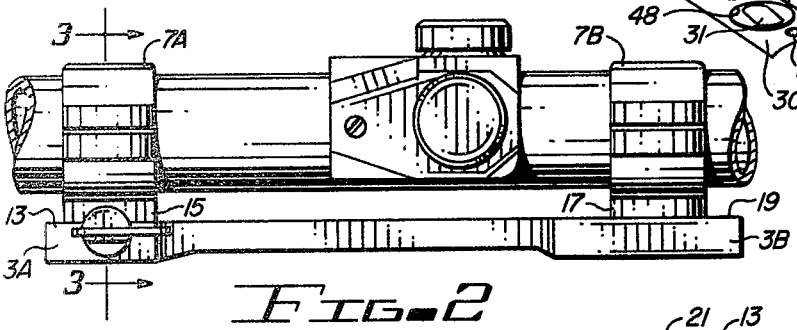
FIG. 2 is a partial side view of the gun scope mounting system of FIG. 1.
Figure 5:
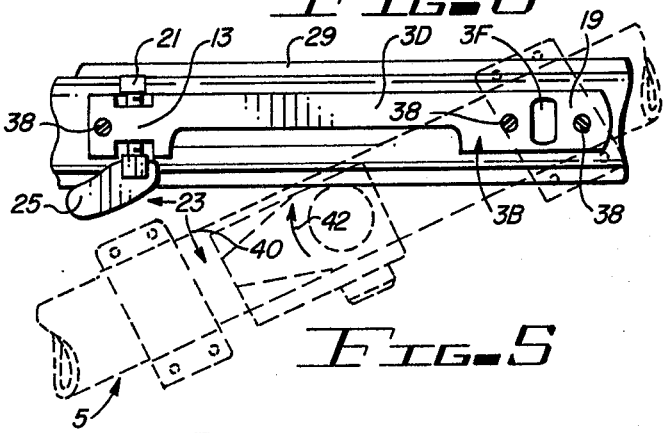
FIG. 5 is a partial top view useful in explaining the operation of the scope mounting system of FIG. 1.

Referring principally to FIGS. 1, 2 and 5, it is seen that forward mounting block 3B includes a horizontal opening 3F.

A male dovetail 31 aligned with the axis of scope 5 extends downwardly from the bottom of a pedestal (similar to pedestal 15 in FIG. 3) of the lower portion of ring clamp assembly 7'. When telescope 5 and clamp ring assembly 7' are aligned perpendicularly to the axis of the receiver or barrel 29 of the rifle to which telescope 5 is to be mounted, male dovetail 31 is inserted through hole 3F in forward mounting block 3B. The telescope barrel is then rotated in a direction indicated by arrow 43 in FIG. 5 and male dovetail 31 engages recessed female dovetail 48 (FIG. 1), thereby securing lower clamp ring member 7B' to forward mounting block 3B. This causes lower flat surface 13' of pedestal 15 to be co-planar with upper flat surface 13 of rear mounting block 3A.

Figure 4A:
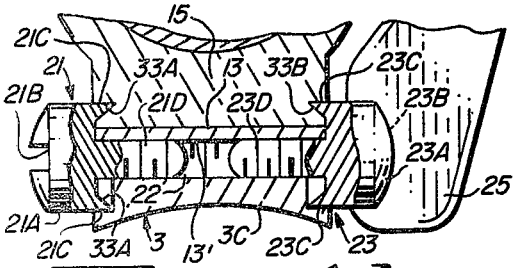
FIGS. 4A–4C are partial sectional views illustrating use of the scope mounting system of FIG. 1.
Figure 4B:
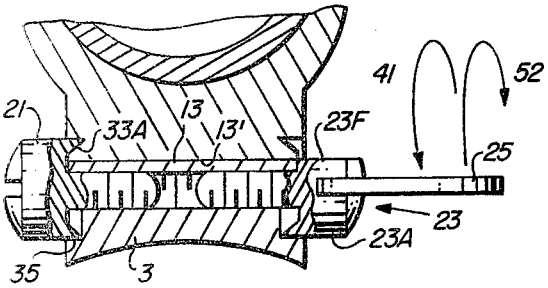
Figure 4C:
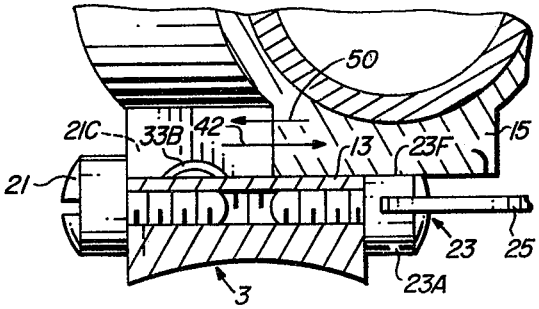

Rear mounting block 3A is moved in the direction indicated by arrow 50 in FIG. 4C, flat surface 13' slides along flat surfaces 13 until the right side of pedestal 15 and convex semi-circular groove 33B therein abuts and mates with flange 23C of left windage screw 21.

Figure 3:
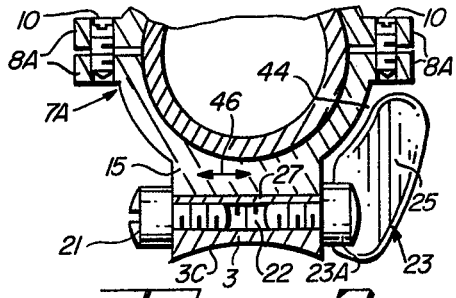
FIG. 3 is a partial section view taken along section lines 3—3 of FIG. 2.

Referring now principally to FIG. 3, the lower surface of pedestal 15 is previously mentioned flat surface 13'. The upper surface of rear mounting block 3A is previously mentioned flat surface 13. During mounting and dismounting of telescope 5, flat surface 13' of pedestal 15 slides along flat surface 13 of rear mounting block 3A in the directions indicated by arrow 46 in FIG. 3 as the telescope 5 and the clamping rings attached thereto are rotated about male dovetail stud 31 as it rotates in female dovetail recess 48.

A horizontal threaded hole 22 is disposed in rear mounting block 3 beneath machined surface 13. A pair of windage screws 21 and 23 have their respective shafts 21D and 23D (FIG. 4A) threaded into hole 22. Windage screw 21 has a large head 21A which is generally cylindrical, and has a coin slot 21B into which a coin can be placed and utilized as a screwdriver to tighten or loosen windage screw 21.

Cylindrical head 21A has a circular concave beveled flange 21C which fits precisely into a semi-circular convex groove 33A in the left side wall of pedestal 15 of rear clamp ring 7A.

Windage screw 23 also has a partially cylindrical head 23A and a coin slot 23B therein. (A removable wing clip 25, described subsequently, fits snugly into slot 23B to facilitate mounting and dismounting of telescope 5 from base 3 without the necessity of utilizing a coin or screwdriver, as explained later.)

Windage screw head 23A has a convex semi-circular beveled flange 23C which tightly and snugly fits into a semi-circular beveled groove 33B in the right hand wall of pedestal 15. Head 23 has a flat surface 23F which is parallel to the longitudinal axis of windage screw 23. When windage screw 23 is rotated to the position shown in FIG. 4B and 4C, flat surface 23F is co-planar with surface 13 during both mounting and dismounting of telescope 5 so that the lower surface of pedestal 15 can pass over head 23A of right windage screw 23 (FIG. 4C).

Thus, it can be seen that when telescope 5 is rigidly mounted, as shown in FIG. 4A, the inner beveled surfaces of flanges 23C and 21C exert in both an inward horizontal force component and a downward vertical force component on convex grooves 33B and 33A, respectively, tightly securing surface 13′ of pedestal 15 against surface 13 of rear mounting block 3C.

When pedestal 15 is in the position shown in FIG. 4B and right windage screw 23 is rotated in the direction indicated by arrow 52, this causes flange 23C of right windage screw 23 to tightly engage semi-circular slot 33B on the right hand wall of pedestal 15 of rear clamp ring 7A′, completing the operation of mounting telescope 5 on base 3.

The procedure for dismounting scope 5 involves precisely the reverse of the sequence of steps involved in mounting the telescope. More specifically, right windage screw 23 is rotated in a direction indicated by arrow 41 in FIG. 4B, and the barrel or tube of telescope 5 is rotated in the direction indicated by arrow 40 in FIG. 5 so that flat surface 23F is co-planar with machined surface 13. Pedestal 15 is moved in the direction indicated by arrow 42 in FIG. 4C. (Turning right windage screw in the direction indicated by arrow 41 loosens windage screw 23, while rotating it in the direction indicated by arrow 52 tightens it.)

Telescope 5, as indicated in dotted lines in FIG. 5, is then removed by rotating it in the direction indicated by arrow 40 until male dovetail 31 is aligned with hole 3F in forward mounting block 3B. Male dovetail 31 is then lifted through opening 3F. The scope dismounting operation then is complete.

Figure 6:
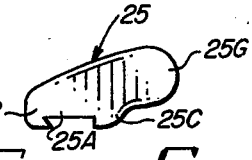
FIG. 6 is a side view of a removable wing clip which can be securely attached within a coin slot of one of the windage screws of FIG. 1.

Referring to FIG. 6, previously mentioned wing clip 25 has a body 25G which extends similarly to the wing of a wing nut, enabling the user to achieve considerable leverage when tightening or untightening right windage screw 23. A cut 25A in wing clip 25 is bounded by a vertical edged tab 25C and a sloped edged tab or hook 25B which digs into the outer wall of cylindrical head 23A of right windage screw 23. If the thickness of wing clip 25 is precisely equal to the width of coin slot 23B of right windage screw 23, wing clip 25 remains securetly engaged to right windage screw 23. However, by exertion of a reasonable amount of force wing clip 25 can be removed to facilitate initial mounting and adjustment of left and right windage screws 21 and 23. Once initial adjustment of the left and right windage screws has been attained, then wing clip 25 can be attached as shown in FIGS. 1, 3 and 4A.

The foregoing telescope mounting apparatus has numerous advantages over the previously described Redfield telescope mounting apparatus utilizing two identical windage screws. First, neither of the windage screws of the apparatus disclosed herein needs to be completely removed in order to mount or dismount the telescope from the base (which is permanently and rigidly attached to the receiver or barrel of the gun). This avoids the likelihood that a removed windage screw will be lost when removed hastily under field hunting conditions. Another advantage is that once the windage screws are initially adjusted, mounting and dismounting of the telescope can be accomplished by turning the second windage screw by less than a single turn. Use of the removable wing clip avoids clearance problems with the receiver or barrel of a rifle during initial adjustment of the two windage screws. Since the wing clip tightly engages the head of the second windage screw, and requires considerable force to remove it, there is very little danger of a wing clip being lost, yet its use obviates the need for searching for a coin or a screwdriver to mount or dismount the telescope. Finally, the cost of the above described telescope mounting apparatus is only slightly greater than the cost of the presently popular low-cost Redfield system and far less costly than the Griffin system.

While the invention is described with reference to a particular embodiment thereof, those skilled in the art will recognize that various modifications thereto can be made without departing from the truth, spirit and scope of the invention, as set forth in the appended claims. For example, the wing clip can be permanently attached to a windage screw if the ear of the wing clip extends from the head of the windage screw at an angle which ensures that the ear will clear the receiver or barrel of the gun when the windage screw is rotated.

I claim:

1. A telescope mounting apparatus for mounting a telescope on a gun, said telescope mounting apparatus comprising in combination:

a. a first mounting block rigidly attached to the receiver or barrel of the gun, said first mounting block having therein a circular female dovetail recess;

b. a second mounting block rigidly attachable to a receiver or barrel of the gun at a distance from said first mounting block, said second mounting block having a flat top surface and first and second opposed sides having therein first and second threaded holes, respectively;

c. a first clamp ring assembly attachable to said first mounting block for rigidly engaging the body of the telescope and removably engaging said first mounting block, said first ring assembly having a male dovetail stud rotatably engagable with said female dovetail recess of said first mounting block;

d. a second clamp ring assembly attachable to said second mounting block for rigidly engaging the body of the telescope, said second ring assembly including a lower pedestal having a flat bottom surface which is parallel to said flat top surface and substantially co-planar therewith when the male dovetail stud is engaged with the female dovetail recess;

e. first windage screw means disposed in the first threaded hole for retaining the first side of the pedestal, said first windage screw means having a first head which extends above the flat top surface to engage the first side of the pedestal; and f. second windage screw means disposed in the second threaded hole for engaging the second side of said pedestal, said second windage screw means including a second head, the second head having a first flat surface, said second windage screw means being rotatable so that a first portion of the second head extends above the flat top surface and engages the second side of the pedestal, said second windage screw means being further rotatable so that said first flat surface is substantially parallel to the flat top surface and is at the same height as or lower than the flat top surface, whereby the telescope and said first and second clamp ring assemblies can be mounted on the gun by turning said second windage screw emeans so that said first flat surface is parallel to the flat top surface and is at a height equal to or less than the height of the flat top surface, rotating the telescope so that the male dovetail stud engages the female dovetail recess, and sliding the flat bottom surface of the pedestal across the flat top surface of said first mounting block until the first side of the pedestal engages said first windage screw means, and tightening said second windage screw means, the first portion of said second head of said second windage screw means engaging the second side of the pedestal.

2. The telescope mounting apparatus of claim 1 further including a spanning member connecting said first and second mounting blocks, said first mounting block being a forward mounting block and said second mounting block being a rear mounting block.

3. The telescope mounting apparatus of claim 1 wherein said first windage screw means includes a first windage screw having a first head, said first head being substantially cylindrical, said first head having a first circular interiorally beveled flange which engages the first side of the pedestal, wherein said first side of the pedestal has therein a semicircular beveled groove for receiving said first circular flange to exert an inward force component and a downward force component upon said pedestal, said second windage screw means including a second windage screw having a second head, said second head being substantially cylindrical, the second head having therein a second beveled semicircular flange which terminates in said first flat surface of the second head for engaging the second side of the pedestal, the second side of the pedestal having a second semi-circular beveled groove for receiving the second beveled semi-circular flange to produce an inward force component and a downward force component on the pedestal.

4. The telescope mounting apparatus of claim 3 wherein said first flat surface of the second head is substantially parallel to the axis of the threaded shaft of the second windage screw and wherein the axis of the threaded shaft of the second windage screw is substantially parallel to the flat top surface of said second mounting block.

5. The telescope mounting apparatus of claim 4 wherein said second windage screw includes a slot disposed in the extreme end of said second windage screw for enabling a user to immediately tighten or loosen said second windage screw utilizing a coin or a screwdriver.

6. The telescope mounting apparatus of claim 5 further including wing clip means removably engageable with the second head of said second windage screw to enable the user to conveniently tighten or loosen said second windage screw without utilizing a coin or screwdriver.

7. The telescope mounting apparatus of claim 6 wherein said wing clip means includes an ear which extends to one side of the second head of said second windage screw, enabling the user to achieve leverage to tighten or loosen said second windage screw, said ear clearing the barrel of the telescope during rotation of said second windage screw.

8. The telescope mounting apparatus of claim 7 wherein the threads of the threaded shaft of said second windage screw are inclined to enable the user to both adequately tighten said second windage screw against the pedestal to securely engage the telescope to the second mounting block and loosen said second windage screw sufficiently to enable removal of the telescope from the gun with less than one rotation of said second windage screw and without removal of said second windage screw from said threaded hole.

* * * * *